US006840458B2

(12) United States Patent
Kuzuyama

(10) Patent No.: US 6,840,458 B2
(45) Date of Patent: Jan. 11, 2005

(54) FUEL INJECTOR

(75) Inventor: Hiroshi Kuzuyama, Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/910,165

(22) Filed: Jul. 20, 2001

(65) Prior Publication Data

US 2002/0008158 A1 Jan. 24, 2002

(30) Foreign Application Priority Data

Jul. 21, 2000 (JP) ..... 2000-220232

(51) Int. Cl.[7] ..... F02M 47/02
(52) U.S. Cl. ..... 239/88; 239/533.3
(58) Field of Search ..... 239/88–92, 533.3

(56) References Cited

U.S. PATENT DOCUMENTS 5,632,444 A * 5/1997 Camplin et al. ..... 239/88
6,007,000 A * 12/1999 DeLuca ..... 239/533.3
6,371,382 B1 * 4/2002 Niethammer et al. ..... 239/1

FOREIGN PATENT DOCUMENTS

JP 60-222555 11/1985 ..... F02M/51/06

* cited by examiner

*Primary Examiner*—Christopher Kim
(74) *Attorney, Agent, or Firm*—Morgan & Finnegan, LLP

(57) ABSTRACT

A fuel injector includes a needle valve for injecting fuel from an injection port, a cylindrical member containing therein a pushing spring to the needle valve and a sleeve body for receiving the cylindrical member in an abutment condition so as to expose the injection port. A support portion having an enlarged diameter toward an inner circumference of the sleeve body is provided in a part of an outer circumference of the cylindrical member. A posture of the other cylindrical members may be corrected by the cylindrical member having the support portion.

6 Claims, 5 Drawing Sheets

FUEL INJECTOR

FIELD OF THE INVENTION

The present invention relates to a fuel injector used in an automotive diesel engine or the like, and in particular to a fuel injector in which a movable part such as a needle valve is provided in a cylindrical member and this cylindrical member which, in-turn is received in a sleeve body.

DESCRIPTION OF THE RELATED ART

Fuel injectors used in automotive diesel engines, or the like, may be categorized into a pressure accumulation type fuel injector for injecting fuel whose pressure has been pressurized at a predetermined pressure, or pressure increasing type fuel injector for pressurizing fuel upon injection into an engine.

In any type fuel injector, a needle valve and a pushing spring are disposed within a cylindrical nozzle block, which has an injection port at one end. The nozzle block is received in a sleeve body with the injection port exposed at its other end.

Of the above-described fuel injectors, in particular, in the pressure increasing type fuel injector, since the final injection pressure of fuel is high (at about 1,350 bar), the biasing force of the pushing spring to the needle valve is high. Usually, the cylindrical nozzle block, in which the needle valve and the pushing spring are arranged in series, is divided into two or more blocks in the axial direction, with the front end side block abutting within the sleeve body. Other blocks are laid thereon and are assembled in the sleeve body.

A gap is provided between the nozzle and the sleeve body for facilitating assembling or for providing a drain path for leaked fuel.

In the conventional fuel injector with the above-described structure, since the blocks that a radial gap are laid in the axial direction in the sleeve body, if one of the blocks is received in a slanted condition within the sleeve body, smooth operation of the movable part is prevented, which adversely affects the durability of the movable part (such as the needle valve).

Such a problem occurs not only in the case where blocks are laid in the axial direction, in the sleeve body, but also in the case where the one block is received in the sleeve body.

SUMMARY OF THE INVENTION

The present invention has been made in view of the above, and an object of the present invention is therefore to provide a fuel injector that has excellent durability and good assembly characteristics.

In order to attain this and other objects, according to the present invention, there is provided a fuel injector comprising; a needle valve for injecting fuel from an injection port; a cylindrical member containing therein a pushing spring for pushing the needle valve; and a sleeve body for receiving the cylindrical member so as to expose the injection port. The fuel injector also comprises a support portion having an enlarged diameter oriented toward an inner circumference of the sleeve body, provided in a part of an outer circumference of the cylindrical member.

With such an arrangement, when the cylindrical member is received in the sleeve body, the slant of the cylindrical member relative to the sleeve body is corrected with reference to the enlarged diameter support portion of the cylindrical member, so that the position of the cylindrical member within the sleeve body may be corrected. The enlarged diameter support portion is part of the outer circumference of the cylindrical member. The sleeve body, in conjunction with the cylindrical member forms a gap so that the enlarged diameter support portion does not obstruct the assembling of the cylindrical member into the sleeve body.

The tolerance between the enlarged diameter support portion and the sleeve body is such that a gap is kept, to some extent. Preferably, the gap is about 0.1 mm and in the range of 0.02 to 0.2 mm. If the gap is kept at 0.02 mm or more, the gap serves as a drain passage for leaking fuel, and the cylindrical member may be more easily inserted upon assembly. Also, if the gap is kept at 0.2 mm or less, it is possible to keep assembling precision such that the durability of the movable part will not be compromised.

DETAILED DESCRIPTION OF THE PREFERRED EMBODIMENTS

Figure 1:
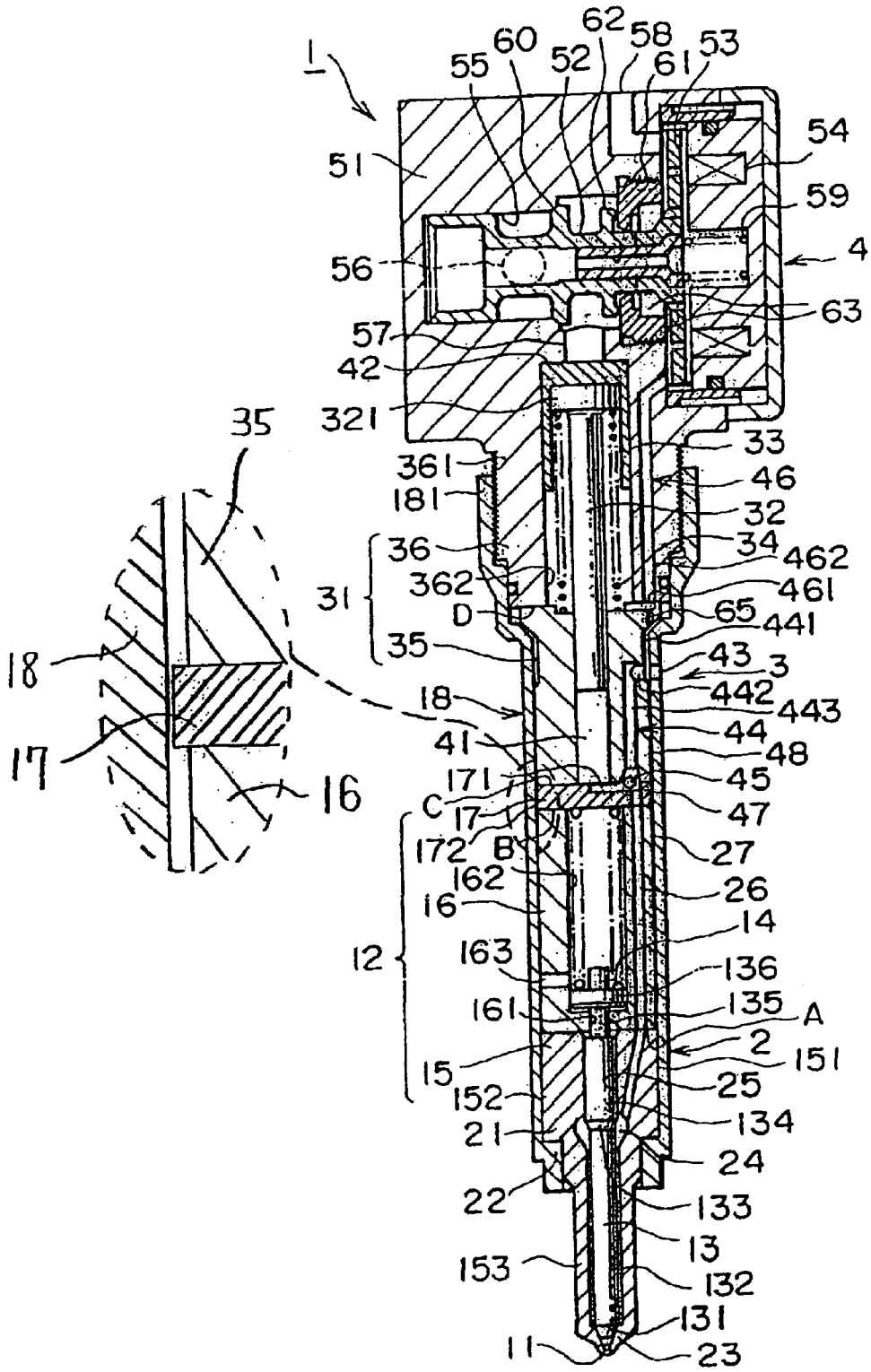
FIG. 1 is an assembled longitudinal view of a fuel injector according to an embodiment of the present invention, showing a sectional view before the injection.

A description of the structure of fuel injector 1 follows. In FIG. 1, fuel injector 1 is composed of an injection mechanism 2, a pressure increasing mechanism 3 and an electromagnetic valve 4. The fuel injector 1 is assembled in an engine such as a diesel engine with the injection mechanism 2 directed downwardly, as shown in FIG. 1. The downward positioning is not limited to the vertical direction, but alternatively may also be in an oblique direction.

The injection mechanism 2 is adapted to be received in a cylindrical nozzle body 12 having an injection port 11 at a lower end under the condition that a needle 13 that is slidable axially is biased by a pushing spring 14. The nozzle body 12 is formed by pushing, in order from below, a first cylindrical member 15, a second cylindrical member 16 and a third cylindrical member 17 into a sleeve body 18 that functions as a casing.

The first cylindrical member 15 has a large diameter portion 152, a shoulder portion 21 and a small diameter portion 153. The shoulder portion 21 is in abutment with a stepped portion 22 of the sleeve body 18 so that the small diameter portion 153 with the injection port 11 at a tip end projects downwardly, A conical valve seat 23, a reservoir portion 24 for highly pressurized fuel and a sliding hole 25 for the needle 13 are formed within the first cylindrical member 15. The needle valve is formed by the needle 13 and the valve seat 23 of the first cylindrical member 15.

The needle 13 is composed of a conical valve portion 131 for the valve seat 23, a small diameter portion 132, a stepped portion 133, a large diameter portion 134, a neck portion 135 and a spring seat 136. The second cylindrical member 16 has a holding hole 161 for the neck portion 135 of the needle 13 and a receiving hole 162 for receiving the pushing spring 14. The pushing spring 14 within the receiving hole 162 is pushed into the sleeve body 18 through the third cylindrical member 17 so as to bias the needle 13 downwardly.

A feed passage 26 for highly pressurized fuel passes at an eccentric position from the center of the third cylindrical member 17 and the second cylindrical member 16. The feed passage 26 is in communication with the reservoir portion 24 for transferring highly pressurized fuel through the first cylindrical member 15.

A gap 151, between the large diameter portion 152 of the first cylindrical member 15, and the sleeve body 18, has an engagement tolerance for fitting within the sleeve body 18. An annular passage 27 of, for example, about 0.5 mm that serves as a drain passage for leaking fuel is formed between the second cylindrical member 16 and the sleeve body 18, An annular passage 47 that is a possible minimum gap of, for example, about 0.1 mm for forming a drain passage for the leaking fuel is formed between the third cylindrical member 17 and the sleeve body 18. Also, the third cylindrical member 17 has a support portion 172 having a larger diameter than an outer diameter of a fourth cylindrical member 35 (to be described later) and the second cylindrical member 16. It is preferable that the engagement tolerance between the third cylindrical member 17 and the sleeve body 18 is in the range of 0.02 to 0.2 mm. Also, the third cylindrical member 17 is a separating plate between the injection mechanism 2 and the pressure increasing mechanism 3 (to be described later), and is formed as a short cylindrical member.

The injection mechanism 2 having the above-described structure is operated as follows. When the highly pressurized fuel is fed to the reservoir portion 24 through the feed passage 26, the stepped portion 133 of the needle 13 serves as a pressure receiving portion so that the pressure against the pushing spring 14 is applied to the needle 13. When the pressure of the highly pressurized fuel reaches a predetermined pressure, the pressure exerted by the highly pressurized fuel and the biasing force of the pushing spring 14 are balanced, the needle 13 moves upwardly. Thus, the valve portion 131 at the tip end is separated away from the valve seat 23, and the highly pressurized fuel, kept at a predetermined pressure is injected from the injection port 11. While the highly pressurized fuel is continuously fed to the reservoir portion 24, the highly pressurized fuel is kept at the predetermined pressure and is continuously injected from the injection port 11. When the highly pressurized fuel is not fed to the reservoir portion 24 so that the pressure of the reservoir portion 24 is lowered, the valve portion 131 at the tip end is seated in the valve seat 23 by the pushing spring 14 acting on the needle 13, thereby stopping the injection of fuel from the injection port 11.

The fuel, leaking from the sliding portion between the sliding hole 25 of the first cylindrical member 15 and the large diameter portion 134 of the needle 13, is introduced into the receiving hole 162 through the space between the holding hole 161 and the neck portion 135. The fuel reaches the annular passage 27 between the sleeve body 18 and the second cylindrical member 16, through a passage 163. Furthermore, the leaking fuel is in communication with an annular space 441 of a low pressure fuel feed passage 44 (located in the upper portion), via an annular passage 47, between the sleeve body 18 and the third cylindrical member 17, and an annular passage 48, between the sleeve body 18 and the fourth cylindrical member 35 (to be described later).

In the pressure increasing mechanism 3, located above the injection mechanism 2, a plunger 32, that is slidable in the axial direction, is coupled with a pressure increasing piston 33 within a cylinder 31. A return spring 34 is received in the plunger 32. The cylinder 31 is composed of the fourth cylindrical member 35 and a fifth cylindrical member 36. The fourth cylindrical member 35 is pushed into the sleeve body 18. A screw portion 361 of the fifth cylindrical member 36 is engaged, via threads, with a screw portion 181 of the sleeve body 18.

A pressure increasing chamber 41 formed into a small diameter hole is formed in the fourth cylindrical member 35, and the plunger 32 is fitted, so as to be slidable, in the pressure increasing chamber 41. A large diameter pressure chamber 42 is formed in the fifth cylindrical member 36. The pressure increasing piston 33 is fitted slidably in the pressure chamber 42. The plunger 32 has a head portion 321 at its upper end. The pressure increasing piston 33 is fitted around the head portion 321. The return spring 34 is disposed between the head portion 321 of the plunger 32 and an upper end of the fourth cylindrical member 35.

A fuel feed port 43 is an opening in a side wall of a portion of the sleeve body 18 corresponding to the fourth cylindrical member 35. The fuel feed passage 44 is formed from the feed port 43 to the pressure increasing chamber 41 over the fourth cylindrical member 35 and the third cylindrical member 17. The fuel feed passage 44 is composed of the annular space 441 formed by: a recess around the fourth cylindrical member 35, a lateral passage 442 within the fourth cylindrical member 35, a vertical passage 443 within the fourth cylindrical member 35 and a radial communication passage 171 on the top surface of the third cylindrical member 17. The vertical passage 443 works in the vertical direction and is in communication with the radial passage 171, and a check valve 45 to allow the direction toward the pressure increasing chamber 41 to be a forward direction. The radial passage 171 of the third cylindrical member 17 is also in communication with the feed passage 26 for highly pressurized fuel.

The annular passage 48 is formed between the fourth cylindrical member 35 and the sleeve body 18 so that the fuel leaking from the injection mechanism 2 flows through the annular passage 47 around an outer circumference of the third cylindrical member 17. The drained working fluid from the pressure increasing chamber 41 of the plunger 32 flows into a hole 362 (in which the return spring 34 is received), and then out of the holes forming the pressure chamber 42 of the fifth cylindrical member 36. The hole 362 is in communication with a first drain passage 46. The first drain passage 46 is composed of a lateral recess portion 461 of the fourth cylindrical member 35, a vertical passage 462 of the fifth cylindrical member 36, and is in communication with a discharge port 58 through a second drain passage 63 to be described later.

The operation of the pressure increasing mechanism 3, with such a structure, is as follows. When the working fluid is fed to the pressure chamber 42, as described below, the fuel within the pressure increasing chamber 41 is pressurized in accordance with the pressure increasing ratio, determined by a ratio of the outer diameter of the pressure increasing piston 33 and the outer diameter of the plunger 32. With the check valve 45 closed, the highly pressurized fuel within the pressure increasing chamber 41 is directed toward the feed passage 26. When the working fluid is discharged from the pressure chamber 42, the pressure increasing piston 33 and the plunger 32 are raised, by the biasing force of the return spring 34, so that the check valve 45 is opened and fuel is introduced into the pressure increasing chamber 41 through the fuel feed passage 44 and the feed port 43.

A description of the structure and operation of the electromagnetic valve 4 for feeding and discharging the working fluid to the pressure chamber 42 follows. The fifth cylindrical member 36 has a block 51 at its head portion. The electromagnetic valve 4 receives, in the block 51: a valve body 52, a yoke 53 and a solenoid 54, and is formed into a three-way two position switching valve. A valve hole 55 is opened perpendicular to the axial direction in the block 51. A working fluid feed port 56, an input/output port 57 (in communication with the pressure chamber 42), and the discharge port 58 (in communication with a fuel reservoir or a fuel collection device), open into the valve hole 55. The valve body 52 is slidably fitted within the valve hole 55. A pushing spring 59 works on the yoke 53 connected to the valve body 52, to thereby close a first valve 60 (between the valve body 52 and the block 51) and open a second valve 62 (between the valve body 52 and a valve hole partition 61). Under this condition, the input/output port 57 is in communication with the discharge port 58 through the second drain passage 63, which is formed by a passage on the side wall of the yoke 53 and the inner circumferential surface of the valve hole partition 61. When the yoke 53, connected to the valve body 52, is attracted by the solenoid 54, the second valve 62 is closed and the first valve 60 is opened. Under this condition, the feed port 56 and the input/output port 57 are in communication with each other so that the working fluid is introduced into the pressure chamber 42.

The first drain passage 46 of the pressure increasing mechanism 3 is in communication with the discharge port 58 via the second drain passage 63 of the electromagnetic valve 4. In the case where fuel is used as the working fluid for the pressure chamber 42 of the pressure increasing mechanism 3, the first drain passage 46 and the second drain passage 63 are in communication with each other so that the drained fuel is returned to the common fuel reservoir or fuel collection device. The fuel feed passage 44 of the pressure increasing mechanism 3 is in communication with the first drain passage 46 through a throttle hole 65, The throttle hole 65 serves to always leak the low pressure fuel from the feed port 43 and may cause air to pass therethrough together with the leakage of fuel if the air is contained in the fuel.

As described above, the sleeve body 18 receives the respective parts of the injection mechanism 2 and the respective parts of the pressure increasing mechanism 3 and is adapted to cover them by the electromagnetic valve 4. The abutment surface A between the first cylindrical member 15 and the second cylindrical member 16, the abutment surface B between the second cylindrical member 16 and the third cylindrical member 17, the abutment surface C between the third cylindrical member 17 and the fourth cylindrical member 35 and the abutment surface D between the fourth cylindrical member 35 and the fifth cylindrical member 36 are adapted to be sealed by the surface pressure. The first to fifth cylindrical members 15, 16, 17, 35 and 36 are pushed into the sleeve body 18 while the necessary preload is applied in the axial direction and are fastened by the threaded engagement between the screw portion 361 of the fifth cylindrical member 36 and the screw portion 181 of the sleeve body 18.

The assembling process of the thus constructed fuel injector 1 will now be described. Firstly, the first cylindrical member 15 and the second cylindrical member 16 in which the needle 13 and the pushing spring 14 are arranged, are pushed into the sleeve body 18. The shoulder portion 21 of the first cylindrical member 15 is brought to abut the stepped portion 22 of the sleeve body 18 to form a seal surface by the surface pressure. Also, the small diameter portion 153 of the first cylindrical member 15 projects thereby exposing the injection port 11.

Subsequently, the third cylindrical member 17, in the form of a short cylinder, serving as the separating plate between the injection mechanism 2 and the pressure increasing mechanism 3, is inserted into the sleeve body 18. The third cylindrical member 17 has an engagement tolerance (fitting tolerance) such that it may be inserted into the sleeve body 18. The outer circumferential surface of the third cylindrical member 17 becomes a support portion 172 having a larger diameter than the outer diameter of the second cylindrical member 16 or the fourth cylindrical member 35, Therefore, the annular passage 27 is formed adjacent to the sleeve body 18 so that a position of the second cylindrical member 16, which causes the gap to be too large, may be corrected by pushing the third cylindrical member 17 so that the gap is of the proper size.

Subsequently, the fourth cylindrical member 35 of the pressure increasing mechanism 3 is inserted into the sleeve body 18. The gap of the fourth cylindrical member 35 is increased in relation to the sleeve body 18 due to the formation of the annular passage 48. The fourth cylindrical member 35 is brought into contact with the third cylindrical member 17, wherein the third cylinder member 17 is kept in the correct position and has an enlarged support portion 172 so that the slant of the fourth cylindrical member 35 may be corrected.

Subsequently, when the first to fourth cylindrical members 15, 16, 17 and 35 are inserted into the sleeve body 18, a necessary preload is applied in the axial direction, and the screw portion 361 of the fifth cylindrical member 36, receiving the pressure increasing piston 33 and the plunger 32, is engaged, via threads, with the screw portion 181 of the sleeve body 18, and fastened in the axial direction.

The necessary surface pressure occurs at the respective abutment surfaces A, B, C and D of the first to fifth cylindrical members 15, 16, 17, 35 and 36 thereby making it possible to realize the surface pressure seal. Also, since the third cylindrical member 17 becomes the enlarged diameter support portion 172 to the sleeve body 18, the axial position of the second cylindrical member 16 and the fourth cylindrical member 35 may be corrected with reference to the third cylindrical member 17.

Figure 2:
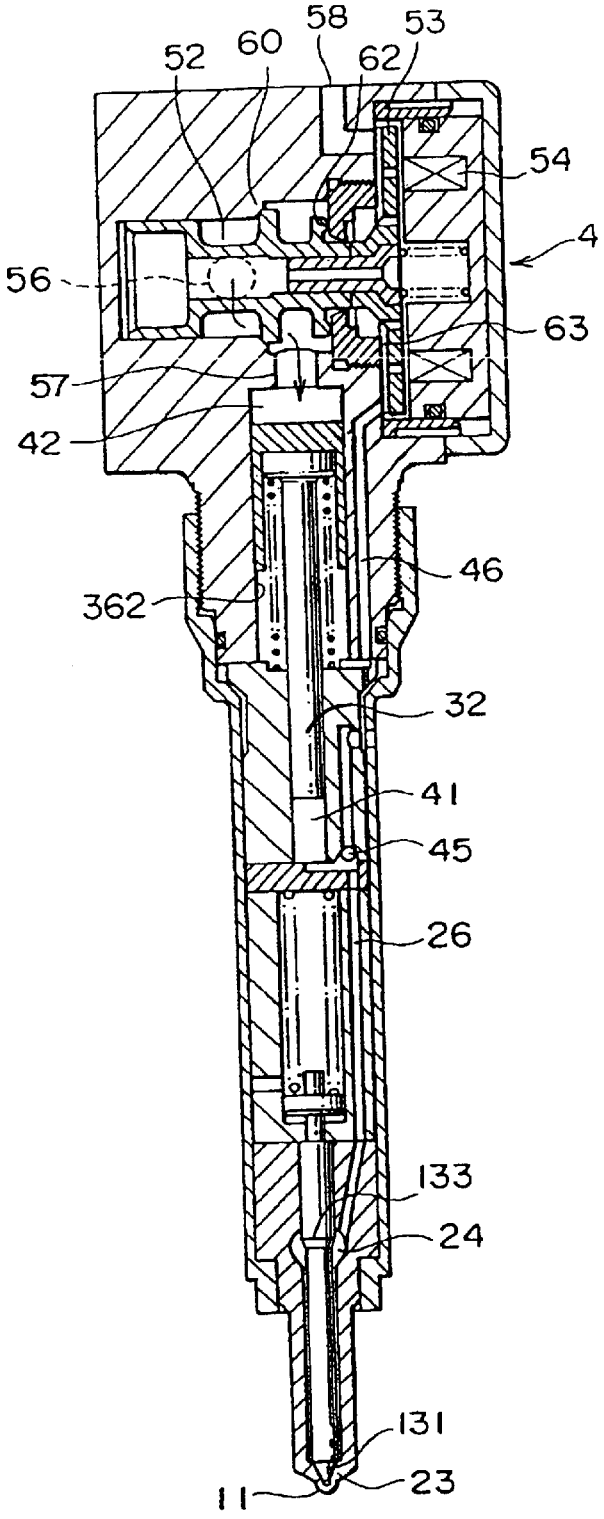
FIG. 2 is an assembled longitudinal view of a fuel injector according to an embodiment of the present invention, showing a sectional view upon the injection.

A description of the operation of the fuel injector 1, thus assembled, follows, with reference to FIGS. 1 and 2. FIG. 1 shows the operating condition of the fuel injector 1 before injection, and FIG. 2 shows the operating condition of the fuel injector 1 upon injection.

In FIG. 1, before injection, low pressure fuel is fed from the feed port 43. The fuel from the feed port 43 is filled into the reservoir 24 through the annular space 441, the lateral passage 442, the vertical passage 443 the check valve 45, through the pressure increasing chamber 41 and the feed passage 26. In this filling process, any air in the fuel passage within the pressure increasing mechanism 3 or the injection mechanism 2 is discharged to the first drain passage 46 through the throttle hole 65.

As shown in FIG. 2, upon the injection, the solenoid 54 of the electromagnetic valve 4 is excited to attract the yoke 53. This moves the valve body 52 toward solenoid 54, opens the first valve 60 and closes the second valve 62 to allow communication between the feed port 56 and the input/output port 57, introducing the working fluid into the pressure chamber 42. The fuel within the pressure increasing chamber 41 is pressurized at the pressure increasing ratio, a ratio of the outer diameter of the pressure increasing piston 42 and the outer diameter of the plunger 32. In this case, the check valve 45 is kept closed so that the high pressure of the pressure increasing chamber 41 is transferred to the fuel within the reservoir portion 24, via the feed passage 26. When the highly pressurized fuel within the reservoir portion 24 becomes, for example, about 200 bar, by the receiving pressure of the stepped portion 133 or the like, the needle 13 overcomes the biasing force of the pushing spring 14 to lift up the valve portion 131 from the valve seat 23 to thereby inject the highly pressurized fuel from the injection port 11. The injection pressure is increased by the throttle effect of the fuel passing through the injection port 11, which, after the opening of the valve is about 1,350 bar.

After completion of the highly pressurized fuel injection, as shown in FIG. 1, the solenoid 54 of the electromagnetic valve 4 is not energized. The valve body 52 and the yoke 53 move away from solenoid 54, in the left direction in the figure, by way of the biasing force of the pushing spring 59, thereby closing the first valve 60 and opening the second valve 62 to allow communication between the input/output port 57 and the discharge port 58. Thus, working fluid is discharged from discharge port 58 and is introduced into the pressure chamber 42. The pressure increasing piston 33 and the plunger 32 are raised by the biasing force of the return spring 34 and return to the positions where fuel may be fed to the pressure increasing chamber 41. The condition shown in FIG. 1 and the condition shown in FIG. 2 are repeated in synchronism with the rpm of the engine, thereby performing suitable fuel injection.

The fuel injector 1, according to the embodiment thus described, has the following effects:

(1) Since the support portion 172 is enlarged to the inner diameter of the sleeve body 18 and is provided in the cylindrical member 17 in the midway of the other cylindrical members 15, 16, 17, 35 and 36, all of which are inserted into the sleeve body 18 and abut each other in the above-mentioned fashion, the position of cylindrical members 15, 16, 35 and 36 in the axial direction may be corrected by adjusting the cylindrical member 17. As a result, the movement of the movable parts, such as the needle 13 and the plunger 32, is smoothened so that seizure due to excess heat, or damage due to bending of movable parts may be prevented.

(2) In the pressure increasing type fuel injector 1 that comprises the combination of the injection mechanism 2 and the pressure increasing mechanism 3, many parts to be inserted into the sleeve body 18 such as the first to fifth cylindrical members 15, 16, 17, 35 and 36 are provided. The assembling precision of the respective cylindrical members 15, 16, 35 and 36 is ensured by the support portion 172 of the third cylindrical member 17. It is therefore possible to adopt a structure in which both the injection mechanism 2 and the pressure increasing mechanism 3 are received in the single sleeve body 18.

(3) The parts to be inserted into the sleeve body 18 are divided into the first to fifth cylindrical members 15, 16, 17, 35 and 36, and the annular passages 27 and 48 of the cylindrical members 16 and 35, other than the third cylindrical member 17 (having the support portion 172), may be enlarged to thereby facilitate the assembling work of the cylindrical members 16 and 35 into the sleeve body 18 while ensuring a sufficient drain passage for the leaking fuel.

(4) Since the third cylindrical member 17, located axially in the middle in the of the first to fifth cylindrical members 15, 16, 17, 35 and 36, and is an enlarged diameter support portion 172 engaged with the sleeve body 18. The second cylindrical member 16 and the fourth cylindrical member 35 may be kept from pivoting, and in the correct position. Also, the third cylindrical member 17 serves as the separating plate between the injection mechanism 2 and the pressure increasing mechanism 3. Therefore, the outer diameter of the third cylindrical member 17, in the form of a short cylinder, is increased to form the support portion 172. Thus, it is possible to readily form the support portion 172, where a support portion, serving as a reference portion, is provided integrally at the lower end of the fourth cylindrical member 35 or the top end of the second cylindrical member 16. This case is described below.

It will be understood that the invention is not limited to the specific embodiment and it is possible to modify or change the specific embodiment as follows.

Figure 3:
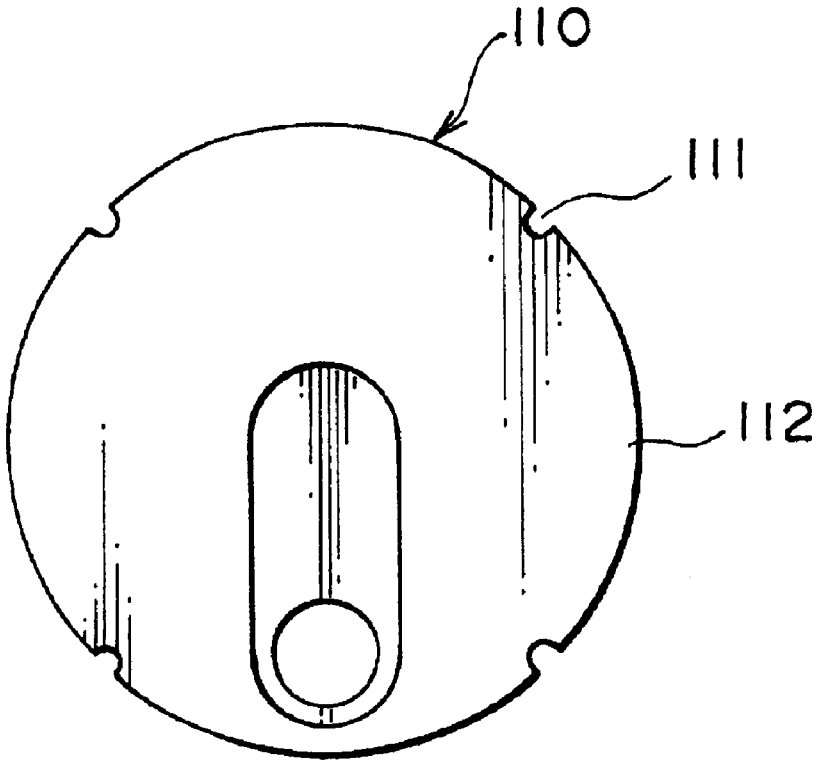
FIG. 3 is a top view showing another support portion of a cylindrical member.
Figure 4:
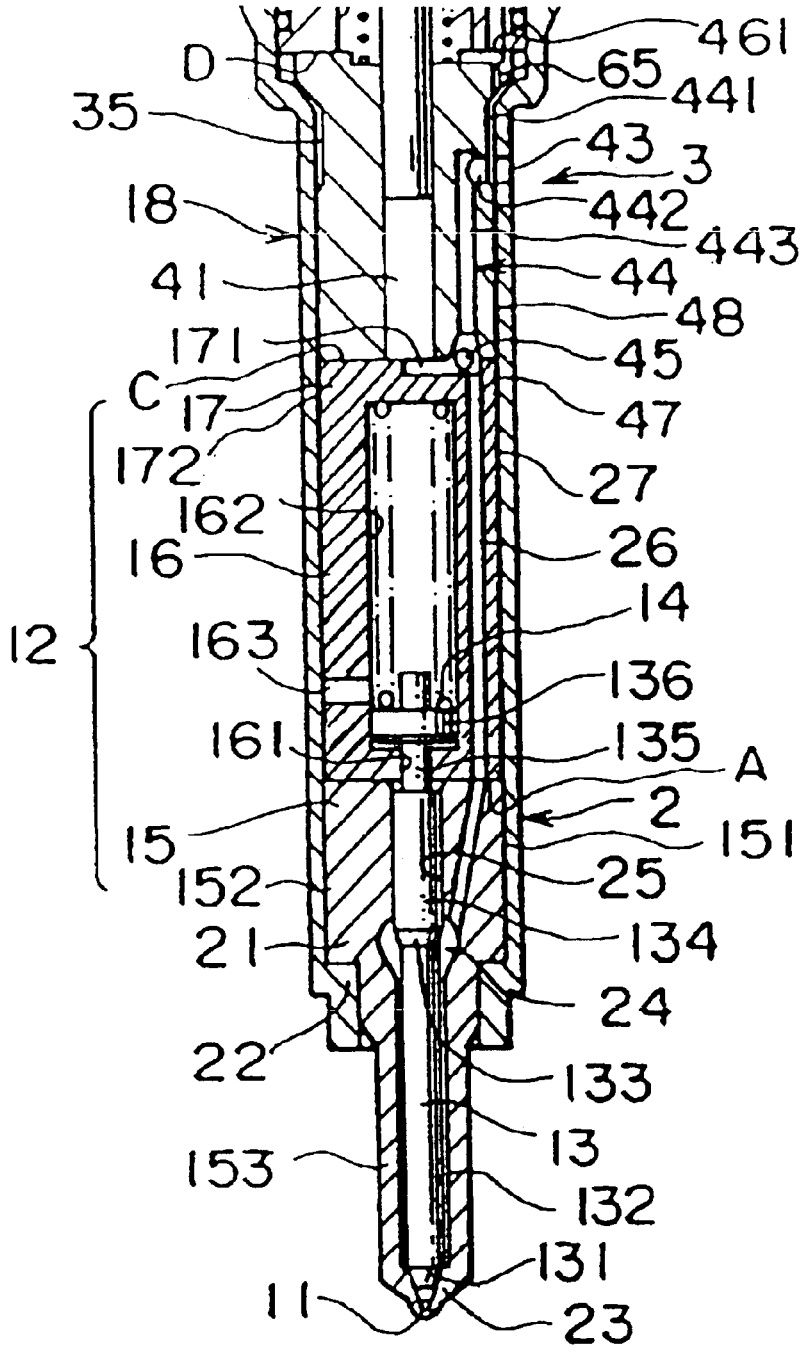
FIG. 4 is an assembled longitudinal view of a portion of a fuel injector according to an alternative embodiment of the present invention, showing the second and third cylindrical members of the embodiment depicted in FIG. 1 formed as one piece.
Figure 5:
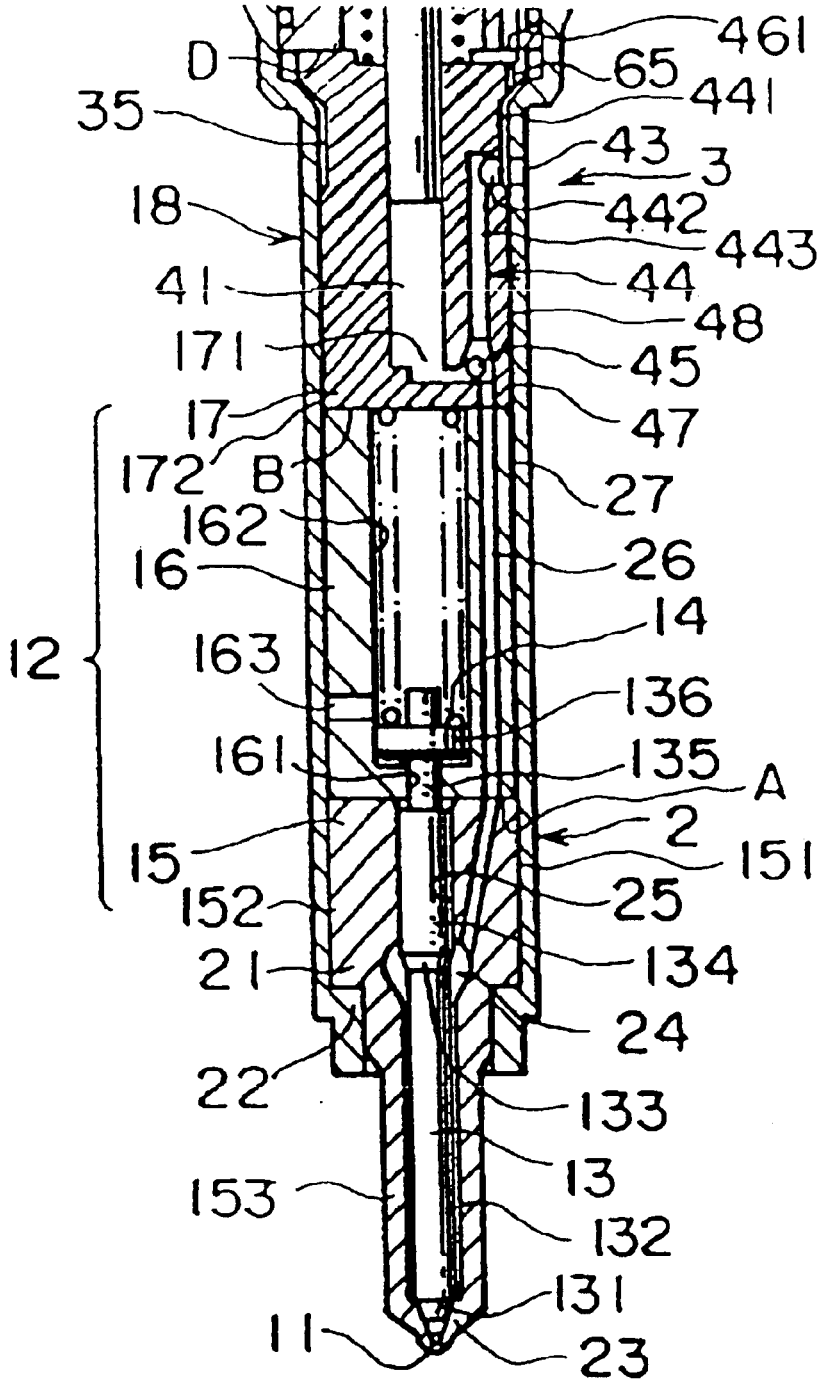
FIG. 5 is an assembled longitudinal view of a portion of a fuel injector according to an alternative embodiment of the present invention, showing the third and fourth cylindrical members of the embodiment depicted in FIG. 1 formed as one piece.

(1) As shown in FIG. 3, cutaways 111 are formed in an outer circumference of a third cylindrical member 110 whereby the cutaways 111 may be used as drain passages of the leaking fuel. In the third cylindrical member 110, the gap to the inner diameter of the sleeve body 18 has a minimum possible engagement tolerance such that it may be inserted in a manner such that a sufficient support portion 112, for engagement with the sleeve body 18, may be formed on the outer circumference of the third cylindrical member 110, Thus, the position of the other cylindrical members to be inserted into the sleeve body 18 may be corrected.

(2) In FIG. 1, the third cylindrical member 17, having the support portion 172, may be integrally formed as an enlarged-diameter upper-end of the second cylindrical member 16 or as an enlarged-diameter lower-end of the fourth cylindrical member 35. In this case, the enlarged diameter portion of the second cylindrical member 16 or the enlarged diameter portion of the fourth cylindrical member 35 serves also as the support portion for support with respect to the sleeve body 18.

(3) The fuel injector to which the support portion in the midway of the cylindrical members is applied, is not limited to the pressure increasing type fuel injector as shown in FIG. 1, and may be applied to the pressure accumulation type fuel injector for injecting the fuel whose pressure is accumulated at a predetermined pressure in advance. In the pressure accumulation type fuel injector, the cylindrical members are received in the sleeve, in an abutting fashion, and the needle valve and the pushing spring are arranged in the cylindrical members. If the support portion, enlarged in diameter, is provided in a part of the outer circumference of the cylindrical members, the position of the cylindrical members within the sleeve body may be corrected.

What is claimed is:

1. A fuel injector comprising:

a nozzle body having a needle valve for opening and closing an injection port, and a tubular sleeve portion having a straight portion with a constant inner diameter;

a first cylindrical member disposed within said tubular sleeve portion;

a second cylindrical member disposed within said tubular sleeve portion, said second cylindrical member is adjacent to said first cylindrical member;

a third cylindrical member disposed within said straight portion of the tubular sleeve portion, wherein said second cylindrical member abuts and is on an injection port side of said third cylindrical member and said third cylindrical member is a separating plate;

a fourth cylindrical member disposed within said tubular sleeve portion, said fourth cylindrical member contains therein at least a portion of a plunger for pressurizing fuel; and wherein a gap formed between an outer circumference of the third cylindrical member and an inner circumference of the tubular sleeve portion, is smaller than a gap formed between an outer circumference of the second or fourth cylindrical members and the inner circumference of the tubular sleeve portion, wherein cutaways are formed in an outer circumference of said third cylindrical member, said cutaways being formed by communicating apertures at an upper face of said third cylindrical member to apertures at a lower face of said third cylindrical member.

2. The fuel injector of claim 1, wherein the second and third cylindrical members are formed as one piece.

3. The fuel injector of claim 1, wherein the third and fourth cylindrical members are formed as one piece.

4. The fuel injector of claim 1, wherein an outer circumference of said third cylindrical member has a constant outer diameter.

5. The fuel injector of claim 1, wherein a gap formed between an outer circumference of the third cylindrical member and an inner circumference of the tubular sleeve portion, is smaller than a gap formed between an outer circumference of the second cylindrical member and the inner circumference of the tubular sleeve portion.

6. The fuel injector of claim 1, wherein said cutaways are used as drain passages for leaking fuel.

* * * * *